United States Patent [19]

Walbrecht

[11] 4,025,973

[45] May 31, 1977

[54] HEADBOARD SHEET DISPENSER

[76] Inventor: Ernest Walbrecht, 26 Bank St., Midland Park, N.J. 07432

[22] Filed: Oct. 21, 1975

[21] Appl. No.: 624,480

[52] U.S. Cl. ..... 5/317 R
[51] Int. Cl.[2] ..... A47C 21/00
[58] Field of Search ..... 5/317, 334, 334 C, 334 R; 206/390

[56] References Cited

UNITED STATES PATENTS

| | | | |
|---|---|---|---|
| 2,691,175 | 10/1954 | Brahm et al. | 5/53 R |
| 3,466,679 | 9/1969 | Hess | 5/317 R |
| 3,482,271 | 12/1969 | Enright | 5/53 D X |
| 3,641,600 | 2/1972 | Oats | 5/317 R |

*Primary Examiner*—Paul R. Gilliam
*Assistant Examiner*—Andrew M. Calvert
*Attorney, Agent, or Firm*—Eugene V. Mandel

[57] ABSTRACT

A headboard sheet dispenser for beds. The dispenser includes means for dispensing top and bottom bed sheets from a roll of several sheets. The dispenser also serves as a padded backrest.

10 Claims, 5 Drawing Figures

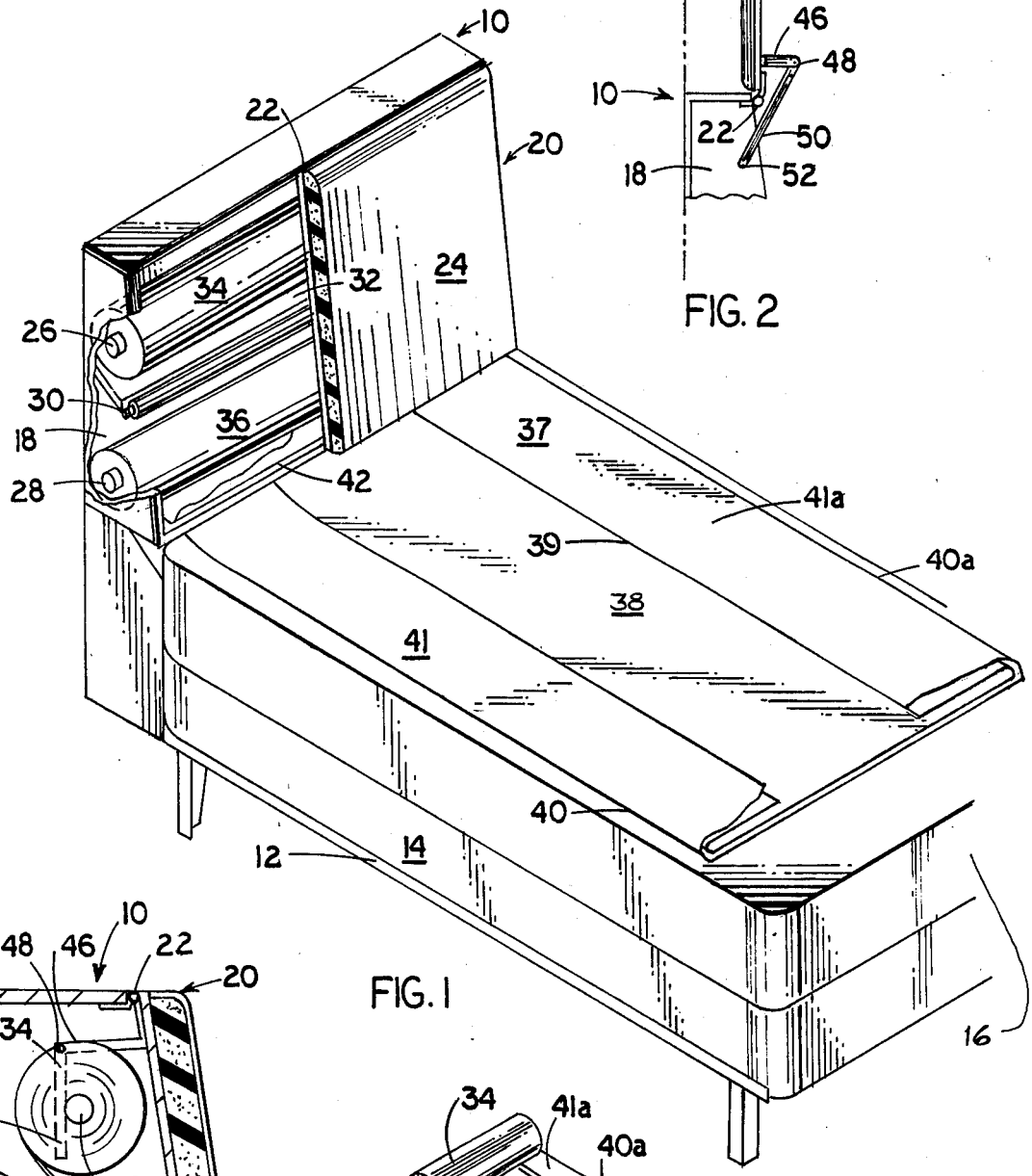
FIG. 1
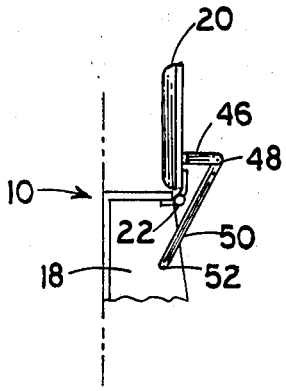
FIG. 2
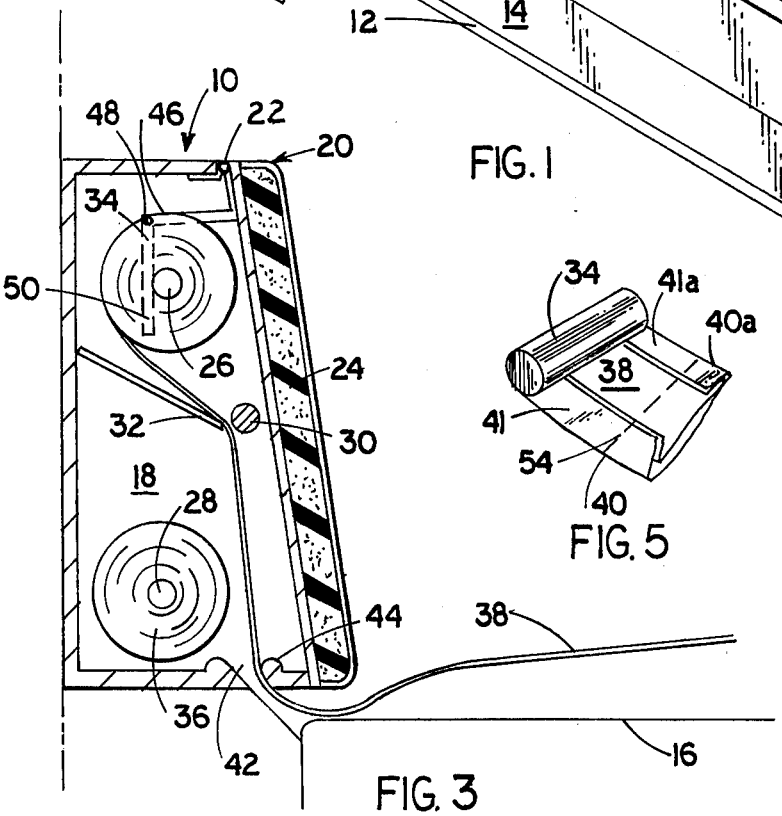
FIG. 3
FIG. 5
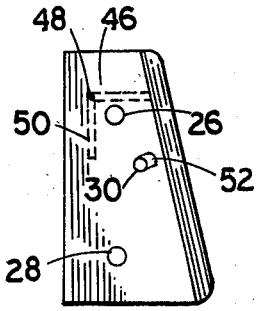
FIG. 4

HEADBOARD SHEET DISPENSER

BACKGROUND OF THE INVENTION

This invention relates to dispensers and, more particularly, to a bed sheet dispenser contained in a headboard that also may serve as a backrest.

Bed sheets in use today are time consuming to change as well as expensive to launder. Also the storage of bed sheets consumes space that can be used for other articles. In applications at hotels, motels, and similar quarters for transients frequent bed changing for sanitary reasons is necessary. This effort can be considerably reduced by the employment of the present invention.

Therefore, it is an object of this invention to provide a headboard contained dispenser that dispenses bed sheets.

It is a further object of the present invention to provide a bed sheet dispenser contained in a headboard that may serve as a backrest, which is readily adapted to cooperate with a standard bedframe.

Another object of the present invention is to provide the dispensing of both top and bottom sheets simultaneously.

Still another object of the present invention is to provide means to separate perforated bed sheets having creased folds on the sides at desired intervals.

Another still further object of the present invention is to provide bed sheets of a disposable material.

These objects, as well as further objects and advantages, of the present invention will become readily apparent after reading the description of a non-limiting illustrative embodiment and the accompanying drawings.

SUMMARY OF THE INVENTION

A headboard bed sheet dispenser, according to the present invention, comprises a chamber adapted to cooperate with a standard bedframe, a first spool within the chamber for retaining a roll of sheets for use, a second spool for storing a spare roll of bed sheets, and means for dispensing the bed sheets.

BRIEF DESCRIPTION OF THE DRAWINGS

FIG. 1 is a pictorial representation of the preferred embodiment of the present invention incorporated in a headboard for a standard bed and bedframe showing the dispensing means;

FIG. 2 is a side view of the hinged panel assembly showing a locking means to secure the panel in the open position;

FIG. 3 is a side view of the preferred embodiment of the present invention showing the dispensing means and combination headboard and backrest;

FIG. 4 is a side view showing the relative positioning of the storage spool, the dispensing spool and the weighted roller;

FIG. 5 is a pictorial representation of a roll of top and bottom bed sheets of the preferred embodiment.

DESCRIPTION OF THE PREFERRED EMBODIMENT

Referring now to the Figures, and more particularly, to a preferred embodiment illustrated in FIG. 1, showing a headboard bed sheet dispenser 10 adaptable to cooperate with a typical bedframe 12 with a boxspring 14 on the bedframe 12 and a mattress 16 in position on the boxspring 14; the top portion of the headboard bed sheet dispenser 10 which contains chamber 18 defined by the peripheral walls of the headboard and which is adapted to cooperate with a hinged panel 20 by a hinge 22 and is padded with material 24. The padded material 24 is preferably foam rubber and may serve as a backrest. Within chamber 18 is the bed sheet dispensing spool 26 and the bed sheet storage spool 28. Also within chamber 18 and below the spool 26 is a weighted roller 30 adjacent to the upper sheet guide 32. The roll of dispensable sheets 34 is shown in position on spool 26 and the roll of spare bed sheets 36 is shown in position on spool 28. The bed sheets 38, comprising, a top sheet 37 and a bottom sheet 39, are shown with folds **40, 40*a*, on mattress 16, being withdrawn from dispenser 10 through a slot 42 in the lower part of chamber 18. Bed sheets 38 are approximately, from side fold 40 to side fold 40*a*, the width of mattress 16 and the folded sections 41, 41*a* are of sufficient length to allow securing under the mattress 16**.

FIG. 2 is an side view of panel 20 which is adapted to cooperate with the dispenser 10 by a hinge 22. Padded material 24 is preferably affixed by glue to the panel 20, the panel 20 is in the open position being held by a bracket 46. A pivot 48 permits bracket 46 to cooperate with bracket 50 and pin 52 which inserts in the side wall of chamber 18 permitting the locking of panel 20 in the open position.

FIG. 3 shows the location of spool 26 above roller 30, in the dispenser 10. The roller 30 is positioned above spool 28 and separated therefrom within chamber 18. Dispensing roll 34 is in position on spool 26 with the sheets 38 positioned in between the upper sheet guide 32 and a weighted roller 30. Sheets 38 are shown adjacent to lower sheet guide 44 and emerging from chamber 18 through slot 42. A spare roll of bed sheets 36 are shown on storage spool 28. Panel 20 is shown in the closed position affixed to the dispenser 10 by a hinge 22.

FIG. 4 is a side view of the dispenser 10 showing the relative positioning of the spool 26 above the weighted roller 30. The weighted roller 30 is permitted to move within a slot 52 causing tensioning of the sheets 38 as shown in FIG. 3.

FIG. 5 is a top view showing a typical roll of bed sheets 34 usable in the preferred embodiment of the present invention 10, wherein, the sheets 38 are extended from the roll 34. The sheets 38 have perforations at desired predetermined intervals to permit separation. The sides of the sheets 38 are folded at **40, 40*a* forming the folded section 41, 41*a***.

In operation the sheets 38 are pulled from the dispenser 10 onto the mattress 16. When the perforations 54 reach the slot 42 the tension of the roller 30 against the upper guide 32 on the sheets 38 cause the sheets 38 to separate from the remainder of the sheets on roll 34. The sheets 38 are then unfolded at the folds **40, 40*a* and are secured under the mattress 16 in the usual manner. A spare roll of sheets 36 is stored on the roller 28 in the lower portion of chamber 18**.

It will be understood that various changes in the details, materials, arrangements of parts and operating conditions which have been herein described and illustrated in order to explain the nature of the invention may be made by those skilled in the art within the principles and scope of the invention.

What is claimed is:

1. A headboard sheet dispenser adapted for use with a bedframe comprising:

a. a chamber within the headboard higher than the bed frame adapted to cooperate with a standard bed frame, the chamber defined by peripheral walls, and a slot opening defined in one of said peripheral walls to permit the exit therethrough of said sheets, and which contains b. a spool for retaining a roll of sheets for use;

c. a second spool for storing a spare roll of bed sheets; and d. a means employing a weighted roller for dispensing bed sheets.

2. A headboard sheet dispenser according to claim 1, wherein a hinged panel assembly is adapted to cooperate with said chamber and to thereby permit said chamber to be open or closed.

3. A headboard sheet dispenser according to claim 2, wherein said hinged panel is padded and may serve as a backrest.

4. A headboard sheet dispenser according to claim 1, wherein said spool retains for dispensing, a roll of top and bottom sheets.

5. A headboard sheet dispenser according to claim 4, wherein said roll of sheets is perforated at predetermined intervals.

6. A headboard sheet dispenser according to claim 4, wherein said sheets are folded on the edges.

7. A headboard sheet dispenser according to claim 1, wherein said dispensing means separates perforated sheets at predetermined intervals.

8. A headboard sheet dispenser according to claim 4, wherein said sheets are made of a disposable material.

9. A headboard sheet dispenser according to claim 2, wherein said hinged panel assembly employs a locking means to secure the panel in the open position.

10. A headboard sheet dispenser according to claim 9, wherein said locking means comprises a pair of brackets, a pivot, and a pin.

* * * * *